US007289078B2

(12) United States Patent
Navarro

(10) Patent No.: US 7,289,078 B2
(45) Date of Patent: Oct. 30, 2007

(54) MILLIMETER WAVE ANTENNA

(75) Inventor: Julio Angel Navarro, Kent, WA (US)

(73) Assignee: The Boeing Company, Chicago, IL (US)

( * ) Notice: Subject to any disclaimer, the term of this patent is extended or adjusted under 35 U.S.C. 154(b) by 376 days.

(21) Appl. No.: 10/917,151

(22) Filed: Aug. 12, 2004

(65) Prior Publication Data

US 2005/0134514 A1 Jun. 23, 2005

Related U.S. Application Data

(60) Provisional application No. 60/532,156, filed on Dec. 23, 2003.

(51) Int. Cl.
*H01Q 13/00* (2006.01)

(52) U.S. Cl. ..... 343/778

(58) Field of Classification Search ..... 343/771, 343/776–779, 853, 772; 342/368; 333/136, 333/137

See application file for complete search history.

(56) References Cited

U.S. PATENT DOCUMENTS 5,276,455 A 1/1994 Fitzsimmons et al.
5,886,671 A 3/1999 Riemer et al.
6,424,313 B1 * 7/2002 Navarro et al. ..... 343/853
6,580,402 B2 6/2003 Navarro et al.
2005/0140556 A1 * 6/2005 Ohno et al. ..... 343/770

* cited by examiner

*Primary Examiner*—Tan Ho
*Assistant Examiner*—Leith A Al-Nazer
(74) *Attorney, Agent, or Firm*—Harness, Dickey & Pierce, P.L.C.

(57) ABSTRACT

A microwave phased array antenna module. The antenna module includes a mandrel having an integrally formed waveguide splitter. Separate electromagnetic wave energy distribution panels that each include DC power, data and logic interconnects, as well as electronic modules incorporating ASICs, phase shifters and power amplifiers, are disposed on opposite sides of the mandrel. Waveguide coupling elements are further secured to the mandrel on opposing sides thereof to couple the electromagnetic wave energy received through an input port of the mandrel with each of the distribution panels. Antenna modules are disposed within openings formed in a second end of the mandrel and electrically coupled via electrical interconnects with the distribution panels. The use of the distribution panels provides ample room for the needed electronics while the use of radiating modules disposed at the second end of the mandrel in a brick-type architecture arrangement relative to distribution panels, enables the extremely tight radiating module spacing needed for V-band operation at up to +/−60° scan angles.

30 Claims, 7 Drawing Sheets

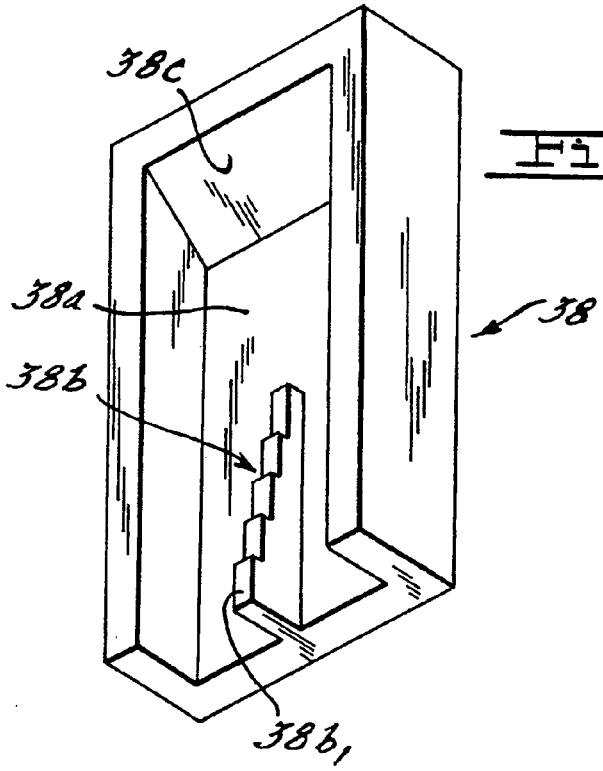
FIG. 4.
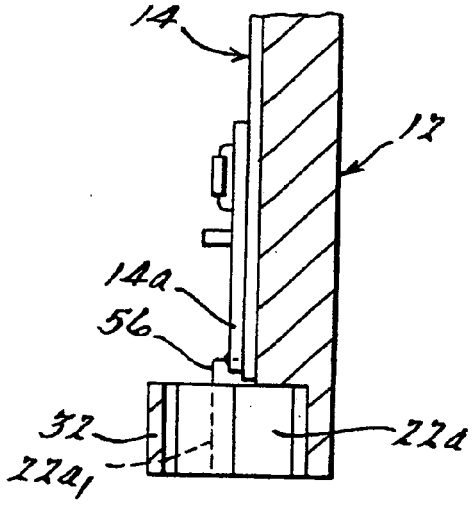
FIG. 5.
FIG. 6.
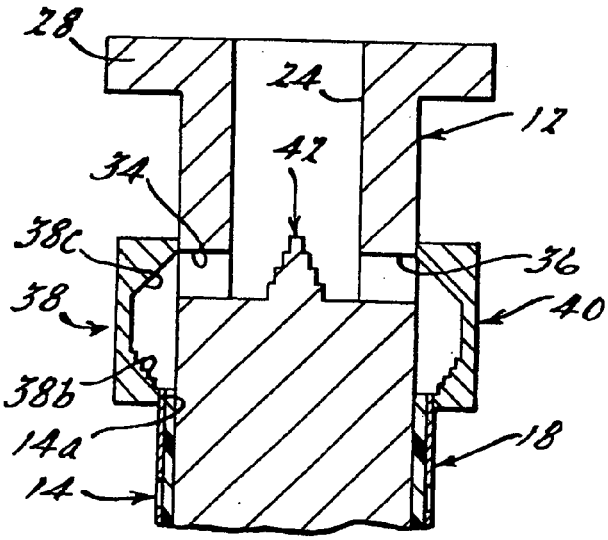

MILLIMETER WAVE ANTENNA

CROSS-REFERENCE TO RELATED APPLICATIONS

This application claims priority from U.S. Ser. No. 60/532,156 filed on Dec. 23, 2003, the disclosure of which is incorporated herein by reference.

FIELD OF THE INVENTION

The present invention relates to antennas, and more particularly to a dual polarized, microwave frequency, phased array antenna.

BACKGROUND OF THE INVENTION

The Boeing Company ("Boeing") has developed many high performance, low cost, compact phased array antenna modules. The antenna modules shown in FIGS. 1*a*–1*c* have been used in many military and commercial phased array antennas from S-band to Q-band. These modules are described in U.S. Pat. No. 5,886,671 to Riemer et. al. and U.S. Pat. No. 5,276,455 to Fitzsimmons et. al., both herein incorporated by reference.

The in-line first generation module has been used in a brick-style phased-array architecture at K-band and Q-band. The approach shown in FIG. 1*a* requires elastomeric connectors for DC power, logic and RF distribution but it provides ample room for electronics. As implemented in FIG. 1*a*, the in-line module provides only a single beam, either linear or right-hand or left-hand circularly polarized. As Boeing phased array antenna module technology has matured, many efforts have resulted in reduced parts count, reduced complexity and reduced cost of several key components. Boeing has also enhanced the performance of the phased array antenna with multiple beams, wider instantaneous bandwidths and improved polarization flexibility.

The second generation module, shown in FIG. 1*b*, represents a significant improvement over the in-line module of FIG. 1*a* in terms of performance, complexity and cost. It is sometimes referred to as the "can-and-spring" design. This design provides dual orthogonal polarizations in a more compact, lower-profile package than the in-line module. The can-and-spring module forms the basis for several dual simultaneous beam phased arrays used in tile-type antenna architectures from S-band to K-band. The fabrication cost of the can-and-spring module has been reduced through the use of chemical etching, metal forming and injection molding technology. The third generation module developed by Boeing, shown in FIG. 1*c*, provides a low-cost dual polarization receive module used in high-volume production at Ku-band.

Each of the phased-array antenna module architectures shown in FIGS. 1*a*–1*c* require multiple module components and interconnects. In each module, a large number of vertical interconnects such as electrically conductive fuzz buttons and springs are used to provide compliant DC and RF connectivity between the distribution printed wiring board (PWB), ceramic chip carrier and antenna probes.

A further development directed to reducing the parts count and assembly complexity for single antenna modules is described by Navarro and Pietila in U.S. application Ser. No. 09/915,836, presently allowed, and assigned to Boeing. The subject matter of this application is also incorporated by reference into the present application and involves an "Antenna-integrated ceramic chip carrier" for phased array antenna systems, as shown in FIG. 1*d*. The antenna integrated ceramic chip carrier (AICC) module combines the antenna probes of the phased array module with the ceramic chip carrier that contains the module electronics into a single integrated ceramic component. The AICC module eliminates vertical interconnects between the ceramic chip carrier and antenna probes and takes advantage of the fine line accuracy and repeatability of multi-layer, co-fired ceramic technology. This metallization accuracy, multi-layer registration can produce a more repeatable, stable design over process variations. The use of mature ceramic technology also provides enhanced flexibility, layout and signal routing through the availability of stacked, blind and buried visa between internal layers, with no fundamental limit to the layer count in the ceramic stack-up of the module. The resulting AICC module has fewer independent components for assembly, improved dimensional precision and increased reliability. The inline module, can-and-spring module, the molded module, and the AICC have been realized as single element modules. So far, the AICC has been implemented by Boeing as a single element phased array module which is connected to the printed wiring board and honeycomb in much the same way as the can-and-spring and injection-molded modules. The AICC approach provides manufacturing scalability from single to multiple elements. As manufacturing/assembly process yields increase, the AICC can be scaled from single to multiple element sub-arrays to reduce parts count and assembly complexity.

A Boeing antenna which departs from a single element module is described by Navarro, Pietila and Riemer in U.S. Pat. No. 6,424,313, also incorporated by reference herein, which is shown in FIG. 1*e*. This module is referred to within Boeing as the "3D flashcube". It has been implemented as a four-element module to provide additional space for electronics. This approach also avoids the use of fuzz buttons and button holders for its vertical interconnects. It has been used successfully to provide two independent simultaneous receive beams at 21 GHz with +/−60° scanning. It has also been implemented at 31 GHz in a switchable transmit application with +/−60° scanning. The 3D flashcube model can also be used to implement more than two independent receive and/or transmit beams.

In FIG. 1*f*, Boeing-Phantom Works further combines many more functions of a phased array antenna into a single component through an approach known as the "Antenna Integrated Printed Wiring Board" ("AIPWB"). This approach is disclosed in U.S. application Ser. No. 10/007,067, presently pending, which is also incorporated by reference into the present application. The approach reduces parts count and further improves alignment and mechanical tolerances during manufacturing and assembly. The improved alignment and manufacturing tolerances improves yield and electrical performance while the reduced parts count shortens assembly time and reduces the number of processing steps required to manufacture the antenna module. This ultimately lowers the overall phased array antenna system costs. The AIPWB approach can be scaled to larger sub-arrays without degrading performance and represents an important step in the direction of more easily and affordably manufactured phased array antenna systems.

The first generation module in FIG. 1*a* is the standard single polarization in-line or brick architecture used extensively for many electronic phased array systems because of the ample room provided for electronics. FIGS. 1*b*, 1*c* and 1*d* uses a tile-type or planar architecture which naturally provides dual polarization. A drawback of the tile architecture is that space is severely limited as frequency and scanning angle increases since the electronics and input/ output pads must fit within the physical area of the radiators in the array lattice. Because of the additional input and output pads required to connect to the RF/DC power/logic distribution, single element modules are further constrained in dimensions. As the array dimensions increase, the single element module pads require tighter dimensional tolerances to ensure alignment and connectivity.

FIG. 1*e* shows another deviation from the single element tile-type modules. It has some of the benefits of tile-type architectures by providing dual polarization and broad-side interconnections to the printed wiring board. It also has some of the benefits of the in-line architectures by providing ample area for electronics and transitions. The 3D flashcube concept has been realized as a quad-module but the approach can be increased to 2×N modules as yield in electronics and packaging increase. The 3D flashcube uses a three layer flexible stripline to provide connections from the electronics to the antennas as well as connections from the electronics to the printed wiring board.

However, even with the 3D flashcube implementation, it is difficult to provide the extremely tight antenna module spacing between adjacent antenna modules that is needed to achieve +/−60° scanning in the microwave frequency spectrum (e.g., 60 GHz). The limitation of using the three layer flexible stripline for interconnections is that as scan angles and frequencies increase, the stripline must be bent at very, very tight (i.e., small) bend radii in order to achieve the extremely close antenna module spacing required for +/−60° scan angle performance in the microwave frequency spectrum. The stripline ground plane and conductor line can break apart at the very small bend radii which is needed to accomplish the extremely tight radiating element spacing necessary for +/−60° scanning at microwave frequencies.

Accordingly, there still exists a need in the art for a dual polarized, phased array antenna which is able to operate within the V-band frequency spectrum (generally between 40 GHz–75 GHz), and more preferably at 60 GHz, while providing at least +/−60° grating-lobe free scanning. Such an antenna, however, requires a new packaging scheme for coupling the electronics of the antenna to the radiating elements in a manner that accommodates the very tight radiating element spacing required for 60 GHz operation, while still providing adequate room for the electronics associated with each antenna module.

SUMMARY OF THE INVENTION

The present invention is directed to a microwave phased array antenna system. The antenna system provides the very close antenna module spacing of adjacent antenna modules needed to achieve operation at 60 GHz (i.e., within the V-band spectrum) while providing a +/−60° scan range. In one preferred form the system includes an electromagnetic wave energy distribution panel that is mounted to one side of a mandrel. The mandrel includes an input for receiving electromagnetic wave energy and a waveguide splitter for channeling the energy to the distribution panel. In one preferred form the mandrel is formed from a single piece of metal with the waveguide splitter machined inside of it. In one preferred form the distribution panel forms a 1×8 microstrip combiner and includes DC power and data logic circuitry. The distribution panel also includes the phase shifters, power amplifiers and applications specific integrated circuits (ASICs) needed for controlling the beam radiated from the module.

The mandrel further includes a second end having a plurality of apertures into which a corresponding plurality of independent antenna modules having electromagnetic radiating elements are disposed. The radiating elements are electrically coupled to the distribution panel via an interconnect assembly coupled at an edge of each distribution panel. In one preferred form the antenna modules each comprise an antenna integrated ceramic chip carrier module such as that shown in FIG. 1*d*.

In one preferred embodiment a pair of electromagnetic wave distribution panels are disposed on opposite sides of the mandrel. The mandrel, in this embodiment includes a 1×2 waveguide splitter formed intermediate first and second ends and in communication with an input at its first end. A pair of waveguide couplers are disposed on opposite sides of the mandrel to cover corresponding ports formed in the mandrel. The couplers couple electromagnetic wave energy split by the splitter and passing through the ports, to each of the distribution panels. Thus, each of the distribution panels receive approximately 50% of the electromagnetic wave energy traveling through the input. In this embodiment, each distribution panel feeds electromagnetic wave energy to one associated subplurality of the antenna modules.

The antenna system of the present invention provides the benefit of an inline architecture through the use of at least one electromagnetic wave distribution panel mounted along a side portion of the mandrel. This provides ample room for the various electronic components needed for the antenna. The use of antenna modules disposed at one end of the mandrel, and the use of the interconnect assembly, provides the very tight radiating element spacing needed for V-band operation. A plurality of the antenna systems described herein can be easily coupled together to form a single, larger antenna system having hundreds, or even thousands, of antenna modules.

Further areas of applicability of the present invention will become apparent from the following detailed description. The detailed description and specific examples are intended for purposes of illustration only and are not intended to limit the scope of the invention.

BRIEF DESCRIPTION OF THE DRAWINGS

The present invention will become more fully understood from the detailed description and the accompanying drawings, in which:

FIG. 4 is a bottom perspective view of the waveguide coupling element;

FIG. 5 is a cross sectional side view taken in accordance with section line 5—5 in FIG. 2 illustrating the 1×2 waveguide splitter formed in the mandrel, with a pair of waveguide coupling elements secured to opposite sides of the mandrel;

Figure 1A:
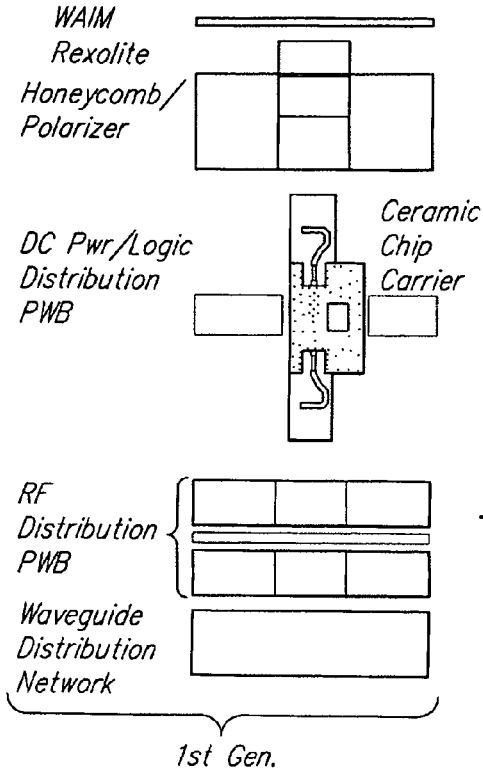
Prior Art Fig. 1a.
FIG. 1*a* illustrates a simplified schematic representation of the elements of an in-line antenna module.
Figure 1B:
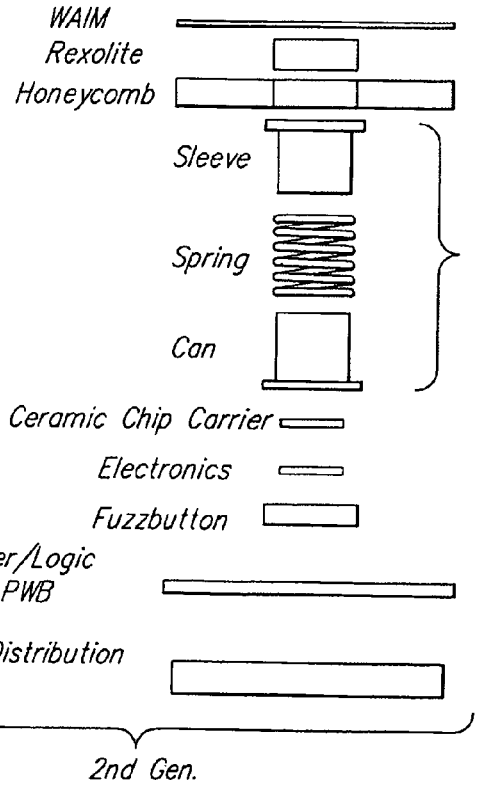
Prior Art Fig. 1b.
FIG. 1*b* illustrates a schematic representation of the elements of a can-and-spring antenna module.
Figure 1C:
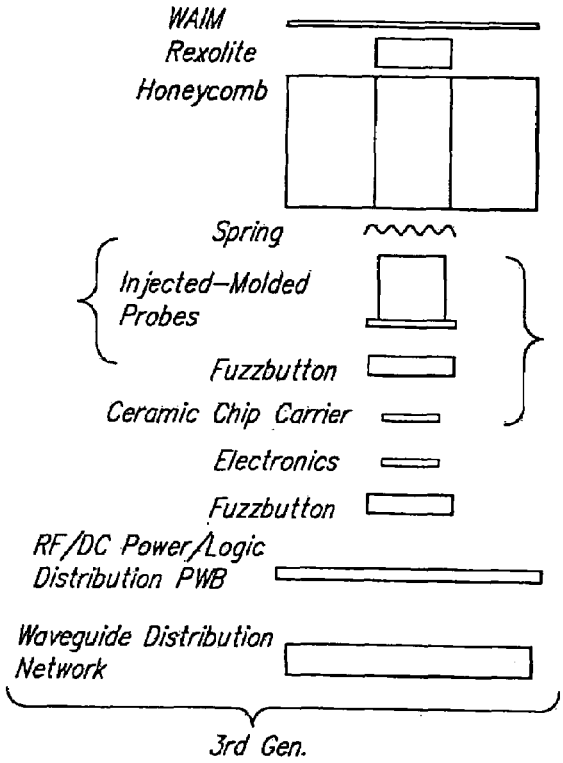
Prior Art FIG. 1c.
FIG. 1*c* illustrates a schematic representation of a molded antenna module.
Figure 1D:
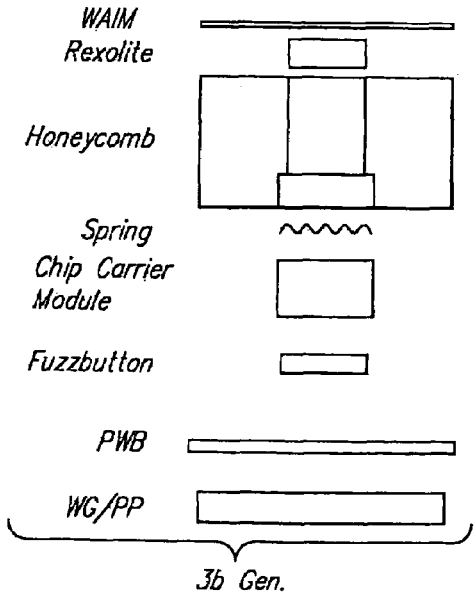
Prior Art FIG. 1d.
FIG. 1*d* illustrates a schematic representation of the elements used to construct an antenna integrated ceramic chip carrier module.
Figure 1E:
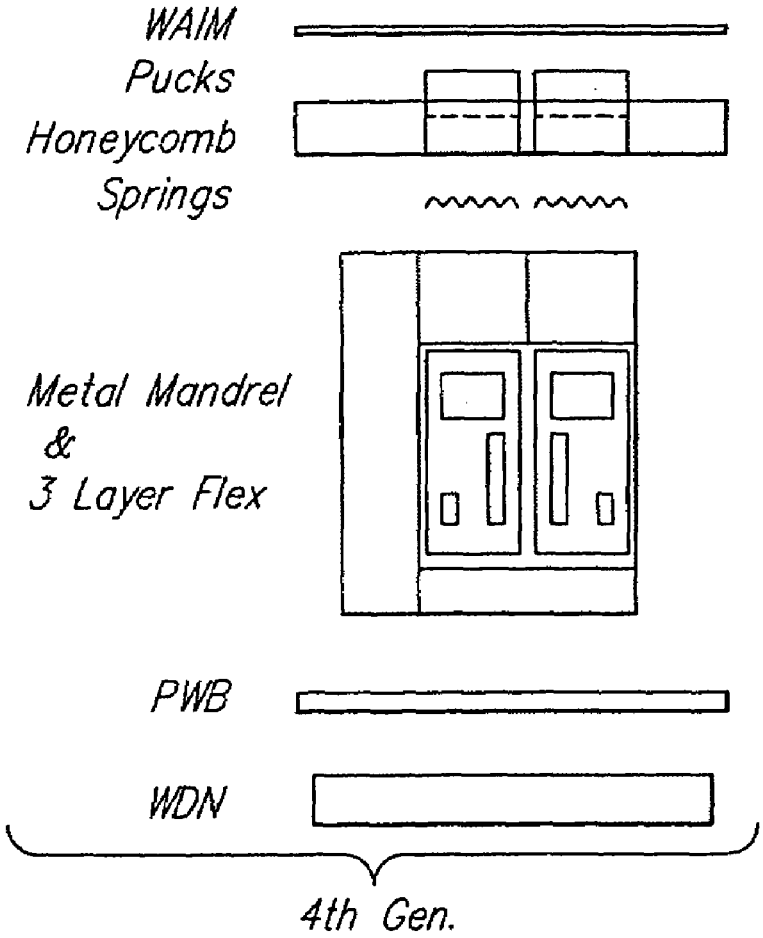
FIG. 1*e* is a simplified schematic view of the elements of a three dimensional flash cube quad-module antenna.
Figure 2:
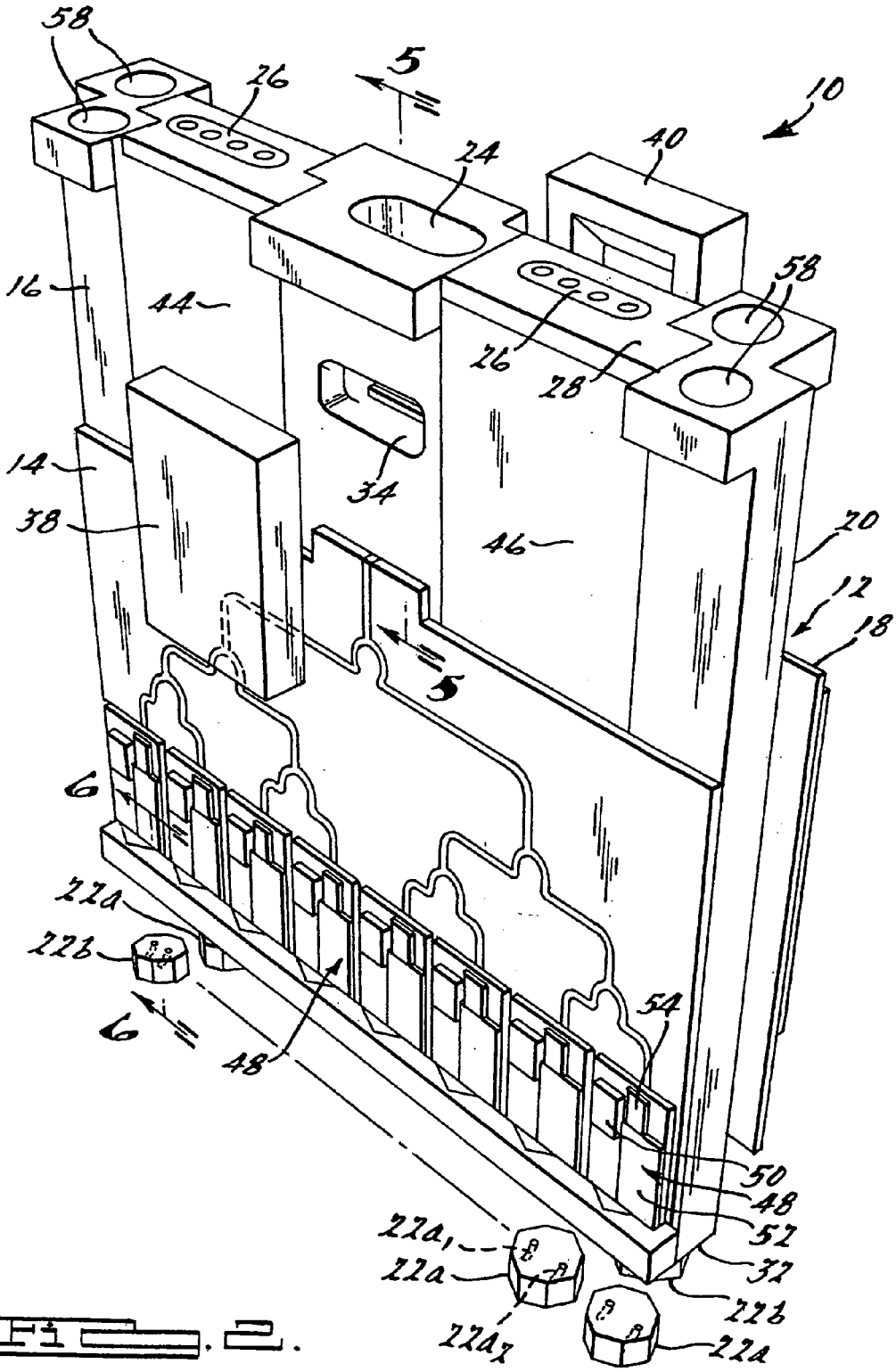
FIG. 2 is a perspective view of an antenna system in accordance with a preferred embodiment of the present invention.
Figure 7:
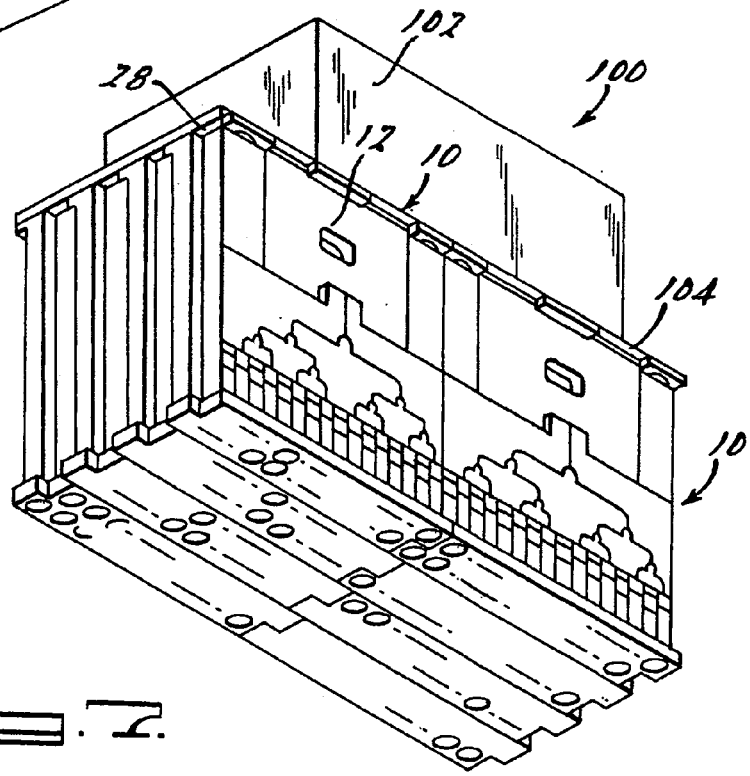
Figure 8:
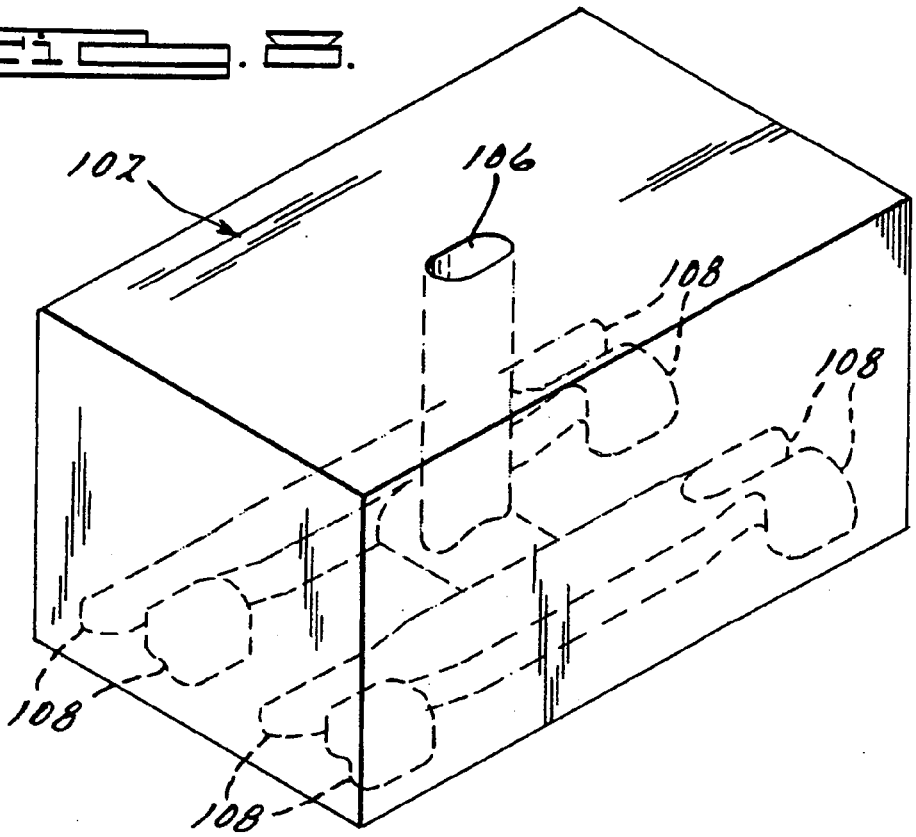
Figure 9:
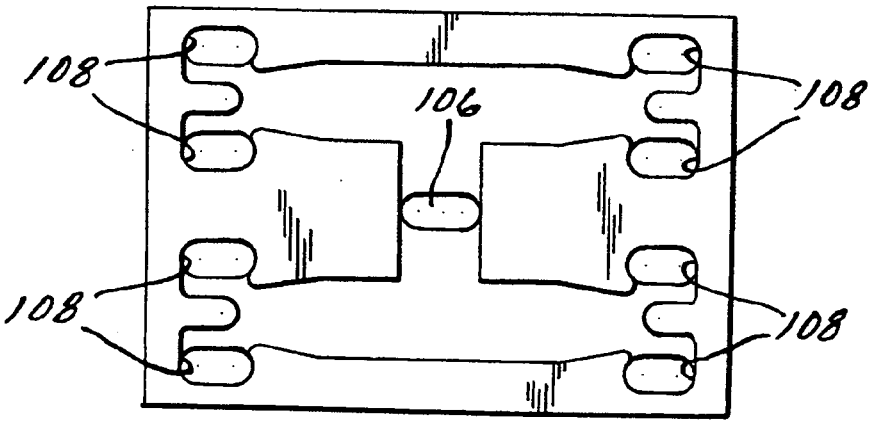

FIG. 6 is a side cross sectional view of the mandrel and antenna module interconnection, taken in accordance with section line 6—6 in FIG. 2;

FIG. 7 is a perspective view of an antenna system incorporating 8 of the antenna modules shown in FIG. 2;

FIG. 8 is a perspective view of the waveguide distribution network component used with the antenna system of FIG. 7; and FIG. 9 is a bottom plan view of the waveguide distribution network component of FIG. 8.

DETAILED DESCRIPTION OF THE PREFERRED EMBODIMENTS

The following description of the preferred embodiment(s) is merely exemplary in nature and is in no way intended to limit the invention, its application, or uses.

Figure 3:
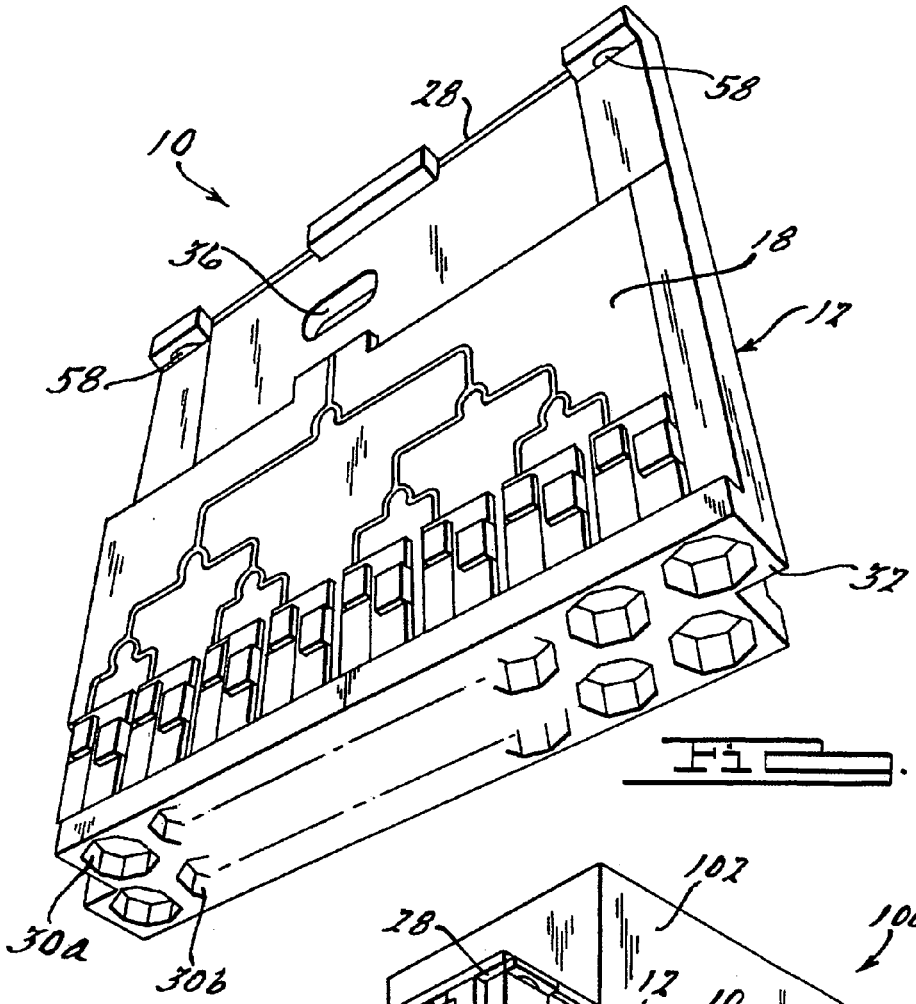
FIG. 3 is a bottom perspective view of the antenna system of FIG. 2 taken from the opposite side of the module, relative to FIG. 2.

FIGS. 2 and 3 illustrate an antenna system 10 in accordance with a preferred embodiment of the present invention. The antenna system 10 is able to operate within the V-band spectrum, and more preferably at 60 GHz, with ±60° scanning capability. The system 10 generally includes a mandrel 12, a first electromagnetic wave energy distribution panel 14 secured to a first side 16 of the mandrel 12, a second electromagnetic wave energy distribution panel 18 secured to a second opposing side 20 of the mandrel 12, and a pair of subpluralities of antenna modules 22*a* and 22*b*. The mandrel 12 includes an input 24 and a pair of spaced apart interconnects 26 for coupling to a printed circuit board (not shown). The interconnects 26 and the input 24 are formed at a first end 28 of the mandrel 12 and the modules 22*a* and 22*b* are disposed in openings 30*a* and 30*b*, respectively, at a second end 32 of the mandrel 12. The openings 30*a* and 30*b* are shown as hexagonal. Other shapes such as circular openings could readily be employed. The openings 30*a* and 30*b* receive the antenna modules 22*a* and 22*b* in the desired orientation.

Modules 22*a* and 22*b* may be AICC modules in accordance with the teachings of U.S. application Ser. No. 09/915,836, presently allowed, the disclosure of which is hereby incorporated by reference. It will be appreciated, however, that any other antenna component that provides the function of an antenna module that radiates electromagnetic wave energy could be implemented.

With further reference to FIGS. 2 and 5, the mandrel 12 includes an opening 34 formed on side 16 and an opening 36 formed on side 20 opposite the opening 34. With specific reference to FIG. 2, a first waveguide coupling element 38 is secured over the opening 34 and a second waveguide coupling element 40 is secured within opening 36. The two waveguide coupling elements 38 and 40 are identical in construction. The openings 34 and 36 are further in communication with the input port 24 and function to couple portions of the electromagnetic wave energy received through input port 24 with its associated distribution panel 14 or 18.

Referring to FIG. 4, the waveguide coupling element 38 is shown in greater detail. Waveguide coupling element 38 is preferably formed from a single block of metallic material, for example aluminum and essentially forms a cover for covering the opening 34. The element 38 includes a recessed area 38*a* having an angled surface 38*c* at one end of the recessed area and a centrally disposed rib that forms a projecting stepped waveguide transition surface 38*b* at the opposite end. One waveguide coupling element 38 is secured over each of openings 34 and 36, such by epoxying or any other suitable means of attachment.

Referring now to FIG. 5, the mandrel 12 includes a 1×2 waveguide splitter 42 formed internally adjacent the openings 34 and 36. The waveguide splitter 42 is longitudinally aligned with the input port 24 to receive the electromagnetic wave energy traveling through the input port 24 and to split the energy into approximately two equal subcomponents. Approximately 50% of the electromagnetic wave energy is directed towards opening 34 and the other 50% towards opening 36. A step $38b_1$ of stepped surface 38*b* contacts a circuit trace 14*a* on distribution panel 14 to transfer the electromagnetic wave energy channeled through opening 34 into the distribution panel. Angled surface 38*c* helps to channel electromagnetic wave energy received by the antenna system into the opening 34 during a receive phase of operation. During a transmit operation, openings 34 and 36 can be termed as "output'" ports, while during a receive phase of operation they would form "input" ports, and input port 24 would instead function as an "output" port.

With further reference to FIGS. 2 and 3, printed circuit boards 44 and 46 couple the interconnects 26 with the distribution panel 14. A similar pair of interconnects (not shown) is disposed on the second side 20 of the mandrel 12 and serves to couple the interconnects 26 with the distribution panel 18.

Referring to FIGS. 2 and 6, each electronic module 48 in distribution panel 14 includes an application specific integrated circuit (ASIC) 50, a power amplifier 52 and a phase shifter 54. Each electronic module 48 is associated with a particular one of the antenna modules 22*a* or 22*b*. With specific reference to FIG. 6, an enlarged view of a portion of the distribution panel 14 illustrates the coupling of one electronic module 48 with one antenna module 22*a*. A metallic wire or pin 56 extending from the antenna module 22*a* contacts the circuit trace 14*a* to make an electrical connection between the module 22*a* and the distribution panel 14. The wire or pin 56 is preferably epoxied to the circuit trace 14*a* or otherwise fixedly secured to make an excellent electrical connection with the electronics module 48. The wire or pin 56 also contacts one of radiating/reception elements (i.e., probes) $22a_1$ of the antenna module 22*a* to electrically couple the distribution panel 14 to the radiating/reception element $22a_1$ of the antenna module 22*a*. In this regard it will be appreciated that each antenna module 22*a* includes a pair of radiating/reception elements in the form of probes $22a_1$, such as illustrated in FIG. 2. Independent pins or wires 56 are independently coupled to each radiating/reception element $22a_1$ and $22a_2$. This form of electrical coupling avoids the bending limitations of a stripline conductor that heretofore has prevented the very close antenna module spacing required for +/−60° scanning in the gigahertz bandwith, and thus allows electrical connections to be made to extremely tightly spaced antenna modules.

The mandrel 12 is preferably formed from a single piece of metal, and more preferably from a single piece of aluminum or steel. The first end 28 further includes a plurality of openings 58 for allowing a plurality of antenna systems 10 to be ganged together to form a larger antenna system composed of hundreds of thousands of antenna modules 22.

With reference now to FIG. 7, an antenna system 100 incorporating eight ones of the antenna system 10 is illustrated. The antenna system 100 includes a 1×8 waveguide distribution network 102 which is coupled to a DC power/logic distribution printed wiring board 104. DC power/logic distribution printed wiring board 104 is in turn coupled to the first end 28 of each mandrel 12 of each antenna system 10. The antenna system 100 thus forms a 128 element millimeter wave (i.e., V-band) phased array antenna system. An even greater plurality of antenna system 10 components can be coupled together to form a 128 element, 256 element, or larger 1×N (where "N" is $2^i$ and "i" is an integer) phased array antenna system. Accordingly, it will be appreciated that antenna systems having varying numbers of radiating elements can be assembled using various numbers of the system 10 of the present invention.

Referring to FIGS. 8 and 9, the 1×8 waveguide distribution network 102 can be seen. Network 102, in this example, functions to divide electromagnetic wave energy received through an input port 106 evenly between eight output ports 108. Each of the output ports 108 are longitudinally aligned with an associated input port 24 of one of the antenna systems 10 to allow a portion of the electromagnetic wave energy passing through the output port 108 to enter the input port 24 of each antenna system 10. It will be appreciated that the printed wiring board 104 includes eight sections or areas which form conventional "pass throughs" (i.e., essentially waveguide structures) to enable the electromagnetic wave energy to pass from each of the outputs 108 through an associated one of the pass throughs and into an associated one of the input ports 24 of one of the antenna systems 10. Interconnects 26 (FIG. 2) further electrically couple with portions of the DC power/logic board 104 on opposite sides of an associated one of the pass throughs so the DC power and logic signals can be provided to the distribution panels 14 and 18 of each antenna system 10.

It is a principal advantage of the antenna system 10 of the present invention that the use of the distribution panels 14 and 18 of each system provide ample room for the electronics required for the antenna system 10, and that the use of the antenna modules 22, which are formed in accordance with a brick-type architecture, enable the extremely tight radiating element spacing required for operation at V-band frequencies. The antenna system 10 thus combines the advantages of previous "tile" type antenna architectures with those of the "brick" type architectures. The antenna system 10 further combines the use of a stripline waveguide (on distribution panels 14 and 18) with an air-filled waveguide (i.e., input port 24) to provide an antenna system with acceptable loss characteristics that still is able to distribute electromagnetic wave energy to a large plurality of tightly spaced antenna modules. The antenna system 10 further enables easy, modular expansion to create a larger overall antenna system having a much greater plurality of antenna modules. Additionally, the antenna system 10 is readily suited for use with conventional waveguide distribution network components (e.g., a corporate waveguide component), thus making the system 10 especially well suited for use in larger (e.g., 128 element, 256 element, etc.) antenna systems.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An antenna comprising:

a waveguide including:

in input port;

a splitter formed within the waveguide and in communication with the input port;

an output port forming an opening in said waveguide and in communication with the splitter to receive a predetermined percentage of electromagnetic wave energy entering said input port and being divided by said splitter;

a distribution subsystem including a waveguide coupling element disposed over said opening communicating with said output port, the distribution system being supported on said waveguide, and for dividing said electromagnetic wave energy received from said waveguide coupling element into a predetermined subplurality of outputs; and a plurality of electromagnetic wave energy radiating modules supported from said waveguide adjacent said distribution subsystem for communicating with said distribution subsystem.

2. The antenna system of claim 1, wherein said distribution subsystem comprises a distribution panel, the waveguide coupling element channeling electromagnetic wave energy exiting said output port into said distribution panel.

3. An antenna comprising:

an electrically conductive structure including:

first and second end portions and first and second side portions;

an input port formed at said first end for receiving electromagnetic wave energy;

a waveguide splitter formed intermediate said first and second ends and in communication with said input port; and a waveguide output port opening onto at least one of said side portions and in communication with said waveguide splitter;

a waveguide coupling element communicating with said waveguide output port to channel electromagnetic wave energy between said input and output ports;

an electromagnetic energy distribution panel disposed adjacent said one side portion of said support structure, and in electrical communication with said waveguide coupling element, and a plurality of electromagnetic energy radiating modules disposed adjacent said second end of said support structure and in communication with an output of said electromagnetic energy distribution panel.

4. The antenna of claim 3, wherein said waveguide coupling element forms a cover having a protruding rib, and wherein said rib contacts a circuit element of said electromagnetic energy distribution panel to make electrical contact therewith.

5. The antenna of claim 4, wherein said rib includes a stepped surface that electrically contacts a portion of said electromagnetic energy distribution panel.

6. The antenna of claim 3, wherein said electromagnetic energy distribution panel comprises a printed wiring board secured against said one side portion of said electrically conductive support structure.

7. The antenna of claim 3, wherein:

said electromagnetic energy distribution panel has a plurality of eight signal outputs; and wherein said electromagnetic energy radiating modules each are electrically coupled to an associated one of said eight signal outputs.

8. The antenna of claim 3, further comprising a corporate waveguide component coupled to said first end of said metallic support structure for directing electromagnetic wave energy into said input of said metallic support structure.

9. An antenna comprising:

a metallic support structure including:

first and second end portions and first and second side portions;

an input port formed at said first end for receiving electromagnetic wave energy;

a waveguide splitter formed intermediate said first and second ends and in communication with said input port for splitting said electromagnetic wave energy into first and second subquantities;

a first waveguide output port opening onto a first one of said side portions and in communication with said waveguide splitter for receiving said first subquantity of electromagnetic wave energy;

a second waveguide output port opening onto a second one of said side portions and in communication with said waveguide splitter for receiving said second quantity of electromagnetic wave energy;

a first cover disposed over said first waveguide output port for channeling said first subquantity of electromagnetic energy;

a second cover disposed over said second waveguide output port for channeling said second quantity of electromagnetic energy;

a first electromagnetic energy distribution panel in electrical communication with said first cover and secured adjacent said first side of said metallic support structure;

a second electromagnetic energy distribution panel in electrical communication with said second waveguide output port and secured adjacent said second side of said metallic support structure;

a first plurality of electromagnetic energy radiating modules disposed adjacent said second end of said metallic support structure, and in communication with said first distribution panel for radiating said first subquantity of electromagnetic wave energy; and a second plurality of electromagnetic energy radiating elements disposed adjacent said second end of said metallic support in communication with said second distribution panel for radiating said second subquantity of electromagnetic wave energy.

10. The antenna of claim 9, wherein each said cover comprises a centrally disposed, electrically conductive rib for contacting a conductive portion of its respective said distribution panel.

11. The antenna of claim 10, wherein said rib has a stepped surface.

12. The antenna of claim 11, wherein each said distribution panel comprises a 1×8 distribution panel for dividing its associated said subquantity of electromagnetic wave energy into eight subquantities of electromagnetic wave energy.

13. The antenna of claim 9, further comprising a power and logic printed wiring board adapted to be secured adjacent said first end of said metallic support structure.

14. The antenna of claim 9, further comprising a corporate waveguide coupled to said metallic support structure adjacent said first end thereof.

15. An antenna comprising:

a mandrel having a first end and a second end, and first and second opposing side portions;

a first port formed in said first end of said mandrel for channeling electromagnetic wave energy into or from said mandel;

a waveguide splitter formed in said mandrel intermediate said first and second ends and in communication with said first port;

a second port in communication with said waveguide splitter and opening onto said first side portion of said mandrel;

a third port in communication with said waveguide splitter and opening onto said second side portion of said mandrel adjacent said first output port;

a first electromagnetic wave energy distribution panel secured to said first side portion of said mandrel;

a second electromagnetic wave energy distribution panel secured to said second side portion of said mandrel;

a first waveguide coupling element secured over said second port for channeling electromagnetic wave energy between said second port and said first distribution panel;

a second waveguide coupling element secured over said third port for channeling electromagnetic wave energy between said third port and said second distribution panel; and first and second pluralities of radiating modules in communication with said first and second distribution panels, respectively, and overlaying said second end of said mandrel.

16. The antenna of claim 15, wherein each said distribution panel comprises a 1×8 distribution panel for channeling said electromagnetic wave energy between said waveguide output and a subplurality of said radiating modules.

17. The antenna of claim 15, further comprising a corporate waveguide network secured adjacent said first end of said mandrel.

18. The antenna of claim 15, wherein said antenna comprises a power and logic printed wiring board secured adjacent said first end of said mandrel.

19. The antenna of claim 15, wherein each said waveguide coupling element includes a rib for making electrical contact with its associated said distribution panel.

20. The antenna of claim 19, wherein each said waveguide coupling element includes a tapering surface spaced apart from said rib for channeling electromagnetic energy between said first port and its associated said distribution panel.

21. An antenna comprising:

a metallic support structure including:

first and second end portions and first and second side portions;

an input port formed at said first end for receiving electromagnetic wave energy;

a waveguide splitter formed within said support structure, intermediate said first and second ends, and in communication with said input port; and first and second waveguide output ports opening onto opposing side portions of the support structure, and in communication with said waveguide splitter;

first and second covers secured over said first and second output ports, respectively, for channeling electromagnetic wave energy to and from said waveguide;

first and second circuit assemblies disposed adjacent said opposing side portions of said support structure and in communication with said output ports for receiving said electromagnetic wave energy; and a plurality of electromagnetic wave energy radiating modules disposed at said second end of said support structure and in communication with said first and second circuit assemblies.

22. The apparatus of claim 21, wherein said support structure comprises a metallic support structure.

23. The apparatus of claim 21, further comprising a pair of waveguide coupling elements adapted to be secured adjacent said output ports for channeling said electromagnetic wave energy into said circuit assemblies.

24. A metallic support structure apparatus for a phased array antenna, comprising:

an input port formed at a first end thereof;

a waveguide splitter formed at a portion intermediate said first end an a second end of said apparatus and longitudinally aligned with said input port to receive electromagnetic wave energy directed into said input and to split said energy into two generally equal portions;

a first port formed on a first side portion of said apparatus and in communication with said waveguide splitter for channeling a first one of said equal portions of electromagnetic wave energy out from said apparatus to a first external circuit board mounted adjacent said first side portion; and a second port formed on a second side portion of said apparatus and in communication with said waveguide splitter for channeling a second one of said equal portions of electromagnetic wave energy out from said apparatus to a second external circuit board mounted adjacent said second side portion.

25. The apparatus of claim 24, further comprising a waveguide coupling element adapted to be secured over said first port to channel said first portion of electromagnetic wave energy into said first external circuit board.

26. The apparatus of claim 24, further comprising a waveguide coupling element adapted to be secured over said second port to channel said second portion of electromagnetic wave energy into said second external circuit board.

27. The apparatus of claim 24, wherein the apparatus comprises a second end portion having a plurality of aligned openings adapted to receive a corresponding plurality of electromagnetic wave radiating modules.

28. The apparatus of claim 24, wherein the apparatus includes an opening formed at said first end adjacent said input port for receiving an external interconnect port therein.

29. A method for forming an antenna module, comprising:

forming a waveguide having an input port, a plurality of output ports, and a waveguide splitter within the waveguide for channeling, and splitting electromagnetic wave energy entering said input port to said output ports;

using a coupling element to channel electromagnetic wave energy passing through one of said output ports into an electromagnetic wave energy distribution subsystem that is supported from said waveguide;

using said electromagnetic wave energy distribution subsystem to further divide said electromagnetic wave energy into a predetermined plurality of outputs; and using a plurality of electromagnetic radiating elements supported from said waveguide and in communication with said distribution subsystem for radiating electromagnetic energy associated with said subplurality of outputs.

30. The method of claim 29, further comprising forming said output ports one on each of a pair of side portions of said waveguide, with said waveguide splitter directing approximately fifty percent of electromagnetic wave energy received from said input port to each of said output ports.

* * * * *